United States Patent [19]

Hansen

[11] 4,268,998

[45] May 26, 1981

[54] BELT SANDER FOR SANDING EXTERNAL AND INTERNAL SURFACES

[75] Inventor: John M. Hansen, Racine, Wis.

[73] Assignee: Emerson Electric Co., St. Louis, Mo.

[21] Appl. No.: 139,075

[22] Filed: Apr. 10, 1980

[51] Int. Cl.[3] ..... B24B 21/16

[52] U.S. Cl. ..... 51/148

[58] Field of Search ..... 51/135 R, 135 BT, 141, 51/148

[56] References Cited

U.S. PATENT DOCUMENTS

| | | | |
|---|---|---|---|
| 1,881,162 | 10/1932 | Aurori | 51/135 R |
| 2,313,254 | 3/1943 | Mead | 51/148 |
| 2,470,615 | 5/1949 | Grover | 51/135 R |
| 3,127,712 | 4/1964 | Krogen | 51/148 |

*Primary Examiner*—Harold D. Whitehead

*Attorney, Agent, or Firm*—Charles E. Markham

[57] ABSTRACT

In a first position an endless sander belt extending over spaced drive and idler pulleys has one run extending straight between the pulleys past an intermediate work station and a return run biased laterally outward therefrom by a swinging idler drum mounted on a pivoted arm. In a second position an intermediate portion of the return run is held parallel with and closely adjacent the straight run by the swinging idler drum and a second idler drum rotating on a fixed pivot. Belt tension is maintained in both positions by an over center acting spring.

6 Claims, 3 Drawing Figures

18
40
42
44
46
16
19
64
48
50
60
56
58
55
54
52
20
26
24
38
30
28
31
36
34
32
12
14

62
68
69
67

10
18
40
44
46
62
64
65
69
60
48
52
54
66
22
26
32
12

BELT SANDER FOR SANDING EXTERNAL AND INTERNAL SURFACES

This invention relates to belt type sanding machines and particularly to means whereby the machine may be quickly and conveniently changed from conventional exterior surface sanding capability to interior surface sanding capability and whereby the sander belt may be quickly and conveniently removed and replaced.

PRIOR ART

The most pertinent prior art which applicant and his representative have knowledge of are U.S. Pat. Nos. 2,313,254 to T. E. Mead and 2,470,615 to L. V. Grover.

In Mead U.S. Pat. No. 2,313,254 a longer belt is required when changing from FIG. 4 to FIG. 1 if the belt is to be maintained perpendicular to the table 39 and parallel with the backing plate 18. In lines 54–55, column 2, page 1, and lines 1–3 and 21, column 1, page 2, Mead states it is desirable to change to a longer belt when switching from the arrangement shown in FIG. 4 to that shown in FIG. 1. Also in Mead it is necessary to loosen the split clamp 30, set the angle of arm 31 more or less precisely and retighten the clamp when changing from FIG. 4 to FIG. 1.

In Grover U.S. Pat. No. 2,470,615 the minimum spacing of internal surfaces which may be sanded is limited to the diameter of idler drum 37.

OBJECT OF THE INVENTION

The primary object of the invention is to provide a generally new and improved belt type sanding machine capable of sanding external and internal surfaces.

A further object is to provide a swinging idler drum mounted on a pivoted arm and an over center acting spring for biasing one run of an endless sander belt in two positions.

A further object is the provision of a belt type sander in which a portion of one run of an endless sander belt extending over drive and idler pulleys is biased laterally outward from its other run in one position and may be quickly and conveniently shifted to a second position in which it is biased in closely spaced and parallel relationship with its other run and in which the belt is of such length that when in an intermediate position permits easy removal from or replacement on the drive and idler pulleys.

Further objects and advantages will become apparent when reading the following description and operation of the machine in connection with the accompanying drawings.

In the Drawings

DESCRIPTION AND OPERATION

Figure 2:
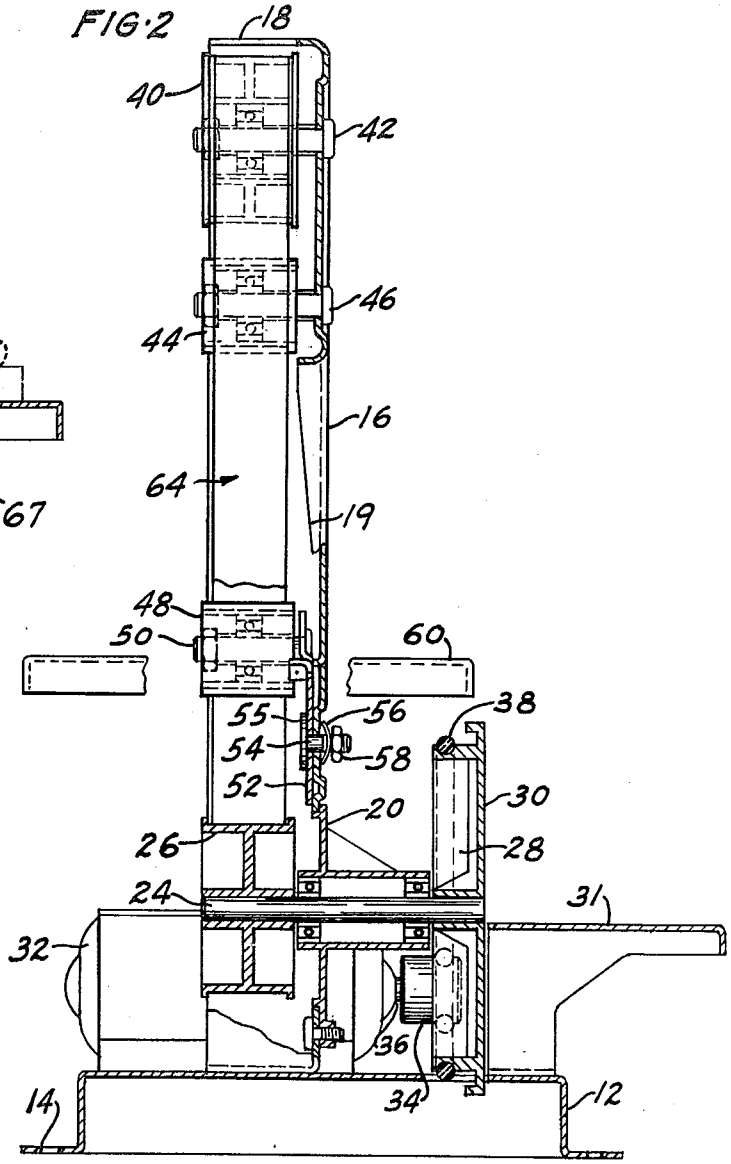
FIG. 2 is a front elevational view of the machine shown in FIG. 1 with parts thereof sectionalized, particularly along lines 2—2 of FIG. 1.

The machine comprises a rigid upright frame generally indicated at 10 and a horizontal base 12 to which the frame 10 is suitably attached. The base 12 has perforated flanges 14 for suitable attachment to a support surface. The frame 10 comprises a rear wall 16 and sidewalls 18 and is open on the side shown in FIG. 1. A suitable snap on cover (not shown) enclosing the open side may be provided.

A rigid housing 20 mounted on a lower portion of the frame wall 16 in line with an aperture 22 journals a shaft 24 therein. Keyed to the left hand end of shaft 24 is a flanged drive pulley 26 and keyed to the right hand end thereof is a large diameter pulley 28 having a face 30 to which a sander disc (not shown) may be attached for sanding work pieces supported on a worktable 31.

An electric motor 32 mounted on base 12 has a small diameter pulley 34 mounted on one end of its drive shaft 36 and a belt 38 extending over the small pulley 34 and the large pulley 28 effects the driving of the large pulley 28 and consequently the flanged drive pulley 26. The machine illustrated is a combination belt and disc sander. Insofar as the prevent invention is concerned any suitable means forming a driving connection between the flanged drive pulley 26 and electric motor 32 may be employed, the disc sanding function of the machine forms no part of the present invention.

A flanged idler pulley 40 is mounted for rotation on a shaft 42 fixed in the rear wall 16 of upright frame 10 near its upper end and an idler drum 44 of somewhat smaller diameter is mounted for rotation on a shaft 46 fixed in the rear wall 16 a short distance below idler pulley 40. A second idler drum 48 is mounted for rotation on a shaft 50 fixed in one end of a freely swinging arm 52. At its other end arm 52 is mounted for rotation on a bolt 54 which passes through a hole in the rear frame wall 16. The arm 52 has an extensive flat surface lying flat against an inner flat surface of the rear frame wall 16 and the bolt 54 has a relatively large diameter head 55 lying against the arm 52. A nut 58 on bolt 54 is tightened against a disc spring 56 just sufficiently to maintain the arm flat against frame wall 16 yet permitting the arm 52 to rotate freely.

A horizontal work support surface 60 suitably attached to frame 10 is positioned between the lower drive pulley 26 and upper idler pulley 40. The drive pulley 26 and idler pulley 40 are of substantially the same diameter with their axes of rotation in substantially vertical alignment to the effect that one run 62 of an endless sander belt 64 extending over these pulleys extends straight and substantially vertical between the pulleys and past the intermediately positioned horizontal work support surface 60. The drive pulley 26 is indicated as rotating clockwise so that the run 62 of belt 64 is the downward run of the belt.

The pivot bolt 54 of arm 52 is positioned between the runs of belt 64, below the work surface 60 and adjacent the drive pulley 26. The endless sander belt 64 is of such length that its upward return run 65 is deflected leftward considerably by engagement of idler drum 48 with its inside surface when the idler drum and arm 52 are swung counter clockwise to the position shown in solid line in FIG. 1. A spring 66 anchored at one end in the rear wall of frame 10 and attached at its other end to freely swinging arm 52 maintains the desired tension on sander belt 64 when in this solid line position.

Figure 3:
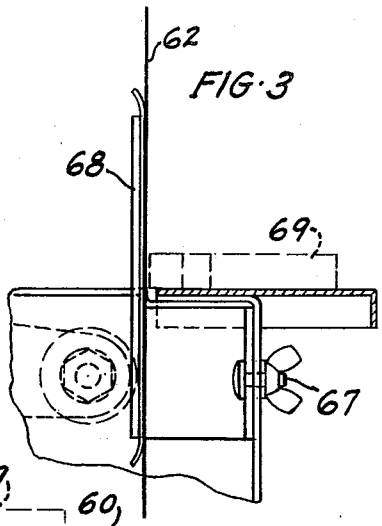
FIG. 3 is a fragmentary view showing the detachable backing plate mounted on the frame.
Figure 1:
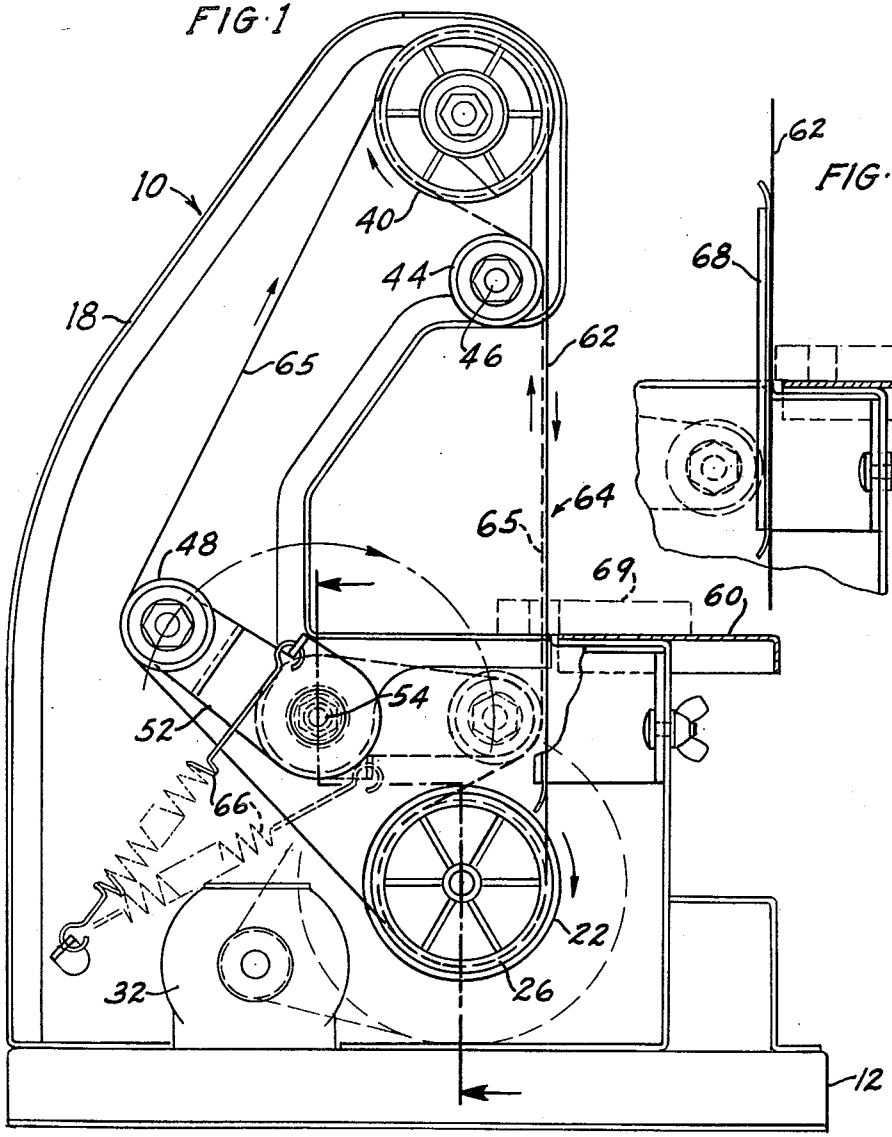
FIG. 1 is a side elevational view of a belt type sanding machine constructed in accordance with the present invention.

In this first position of the sander belt as shown in solid line in FIG. 1 there is ample space between the downward and upward runs 62 and 65 of the sander belt to permit mounting a backing plate 68 detachably connected to the frame by a bolt and wing nut 67 as shown in FIG. 3 so that conventional sanding of the exterior surfaces of a workpiece indicated at 69 may be carried on. Also, in this first position of the belt internal surfaces of a workpiece may be sanded providing opposed internal surfaces thereof are sufficiently spaced and providing the internal surfaces are accessible, as for example, the walls of a recess.

When it is required to sand inaccessible internal surfaces of a workpiece, as when such surfaces form a closed loop defining an aperture or opening in the workpiece, the detachable backing plate 68 is removed. The swinging idler drum 48 is then swung clockwise from its first position indicated in solid line in FIG. 1 so as to slack the sander belt sufficiently to permit its removal from flanged idler pulley 40. This free loop of the belt is passed through the aperture in the workpiece and then replaced on pulley 40 and laid over the upper idler drum 44 with the outer abrasive surface against the drum as shown in dotted line in FIG. 1. The swinging idler drum 48 is then swung further clockwise to a second position shown in dotted line in FIG. 1, wherein the idler drum 48 engages the abrasive side of the upward run 65 of the sander belt and presses it close to the downward run 62. The length of arm 52, the location of its pivot point, the diameter of idler drum 48 and the length of the endless sander belt are such that clockwise rotation of arm 52 is limited to substantially the second position shown in dotted line in FIG. 1.

In this second position the arm 52 is substantially horizontal and perpendicular to the vertical run 62 of the belt so that slight variations from this position of the arm will not appreciably effect the spacing of the now parallel, closely spaced belt runs. Also it will be apparent that the rate of belt tensioning increases as the idler drum 48 approaches the drive pulley 22 thereby to more closely limit the clockwise swing of arm 52 to a horizontal position. The vertical spacing of the arm pivot 54 relative to the pulley 22 is therefore made such that idler drum 48 closely approaches the pulley 22 when arm 52 is swung clockwise to a horizontal position.

Also, the upper idler drum 44 is so positioned and of such diameter that an intermediate portion of the upward run 65 of the belt, between the swinging idler drum 48 and idler drum 44, is now held closely adjacent and substantially parallel with the vertical downward belt run 62. The anchor point of the spring 66 and its point of attachment to arm 52 are such that its point of attachment to arm 52 passes over center when arm 52 is rotated clockwise from its solid line to dotted line positions. The sander belt 64 is therefore suitably tensioned in both positions of the swinging idler drum 48.

The sander belt 64 is also of such length that it may easily be removed from the upper and lower pulleys 40 and 26 when the swinging idler drum 48 is in an intermediate position between its solid line and dotted line positions. The width of the front sidewall 18 of frame 10 is reduced as indicated at 19 to permit the idler drum 48 and arm 52 to swing from the first to second positions.

It will be understood that while the intermediate portion of the upward run 65 of sander belt 64 is shown herein in dotted line in FIG. 1 as being too closely spaced to the downward run 64 when in its dotted line position to permit the inclusion of a backing plate therebetween other arrangements in which this spacing is increased as by shifting the pivot point of arm 52, to provide space for a suitable backing plate are contemplated.

We claim:

1. In a belt sanding machine, a frame, a drive pulley and an idler pulley rotatably mounted on said frame in fixed, spaced relationship, an endless sander belt extending over said pulleys, a freely swinging arm having one end pivotally mounted on said frame, an idler drum mounted for rotation on the other end of said arm for engaging the inner surface of one run of said belt and to deflect and tension it in a direction away from the other belt run when said arm is rotated in one direction to a first position, and for engaging the outer surface of said one belt run and to deflect and tension it in a direction toward said other belt run when said arm is rotated in an opposite direction to a second position, said belt being of such length as to permit the engaged portion of said one belt run to be moved in close proximity with said other belt run when said arm is rotated to said second position, and means tensioning said belt in both positions of said freely swinging arm comprising over center acting spring means connected to said arm and said frame.

2. The belt sanding machine claimed in claim 1 in which said drive and idler pulleys are flanged and in which said belt is of such length that it may easily be removed from said pulleys when said arm is rotated to a position intermediate of its first and second positions.

3. The belt sanding machine claimed in claim 1 which includes a second idler drum for holding an extensive intermediate portion of said one belt run substantially parallel with said other belt run when said arm is in its second position.

4. The belt sanding machine claimed in claim 1 in which said arm is pivotally mounted at a point between said pulleys and between said belt runs and in which said idler drum is adjacent one of said idler pulleys and said arm substantially perpendicular to said other belt run when in its second position.

5. In a belt sanding machine an upright frame, a drive pulley and an idler pulley mounted for rotation on said frame in fixed, vertically spaced relationship, an endless sander belt extending over said pulleys and having one run thereof extending straight between said pulleys, a horizontal work support surface positioned between said pulleys and adjacent said one belt run, a freely swinging arm having one end pivotally mounted on said frame between the runs of said belt and on one side of said work surface, a first idler drum rotatably mounted on the other end of said arm for engaging the inside surface of the other run of said belt to deflect and tension it outward in a direction away from said one belt run when said arm is rotated in one direction to a first position, and for engaging the outside surface of said other belt run and to deflect and tension it in a direction toward and to a position closely adjacent to said one belt run when said arm is rotated in an opposite direction to a second position, a second idler drum mounted for rotation on said frame on the other side of said work surface and between said belt runs, said second idler drum being so spaced from said one belt run that an intermediate portion of said other belt run is held substantially parallel with and closely adjacent to said one belt run when said other belt run is laid over said second idler drum and said arm is rotated to its second position, said belt being of sufficient length to permit laying said other belt run over said second idler drum when said arm is rotated to a position intermediately of its first and second positions, and an over center acting spring connected to said arm and to said frame for biasing said arm in its first and second positions.

6. The belt sanding machine claimed in claim 5 in which said drive and idler pulleys are flanged, in which said belt is of such length that it may easily be removed from said pulleys when said arm is rotated to a position intermediate of its first and second positions, and in which said belt is of such length that said arm is substantially perpendicular to said one belt run when in its said second position.

* * * * *